US006526990B1

(12) United States Patent
Yuhara

(10) Patent No.: US 6,526,990 B1
(45) Date of Patent: Mar. 4, 2003

(54) NETTED REFILL CONTAINER

(75) Inventor: Yukitomo Yuhara, Tokyo (JP)

(73) Assignee: Yoshida Kogyo Co., Ltd., Tokyo (JP)

( * ) Notice: Subject to any disclaimer, the term of this patent is extended or adjusted under 35 U.S.C. 154(b) by 0 days.

(21) Appl. No.: 09/984,221

(22) Filed: Oct. 29, 2001

(51) Int. Cl.[7] ..... A45D 33/02; B65D 69/00
(52) U.S. Cl. ..... 132/307; 132/306; 206/581
(58) Field of Search ..... 32/307, 293, 294, 32/298, 300, 301, 305, 306, 314, 315, 316; 206/581, 823, 235, 37, 1.5; 220/836

(56) References Cited

U.S. PATENT DOCUMENTS

| | | | | | |
|---|---|---|---|---|---|
| 1,911,691 | A | * | 5/1933 | Jacobson | 132/293 |
| 2,919,703 | A | * | 1/1960 | Pinteau | 132/293 |
| 4,557,620 | A | * | 12/1985 | Hancy | 401/200 |
| 5,865,194 | A | * | 2/1999 | Gueret | 132/299 |
| 5,896,866 | A | * | 4/1999 | Quennessen | 132/293 |
| 5,908,037 | A | * | 6/1999 | Pierson | 132/293 |

* cited by examiner

*Primary Examiner*—John J. Wilson
*Assistant Examiner*—Robyn Kieu Doan
(74) *Attorney, Agent, or Firm*—Birch, Stewart, Kolasch & Birch, LLP

(57) ABSTRACT

It is an object of this invention to provide a refill container for preventing the cosmetic material from accumulating on one side by forming the space between the top surface of the cosmetic material K and the netting, as small as possible, and for preventing the quality of cosmetic material from changing.

A netted refill container A comprising: a container body 1 being formed from a flexible synthetic resin material, and opening upward for containing cosmetic material K; a net frame 2 having a netting 2*b* hooked across an engagement loop 2*a*; wherein the net frame 2 is attached in a manner covering an opening portion of the container body 1; wherein the netting 2*b* and the engagement loop 2*a* are attached by an annular attachment portion 2*c* projecting higher upward than the engagement loop 2*a*; wherein the opening portion of the container body 1 has a top edge extending upward and closely contacting to the annular attachment portion 2*c*.

1 Claim, 5 Drawing Sheets

NETTED REFILL CONTAINER

BACKGROUND OF THE INVENTION

1. Field of the Invention

This invention relates to a netted refill container for containing powdery cosmetic material being capable of filling powdery cosmetic material within a container body, and being capable of maintaining the quality of the powdery cosmetic material before usage.

2. Description of Related Art

Presently, a powdery cosmetic material, such as a foundation or white powder, is contained inside a dish-shaped refill container having a netting attached to an engagement loop of a top opening portion, in which the netting serves to prevent the powdery cosmetic material from scattering, and allows a suitable amount of powdery cosmetic material to adhere to a cosmetic tool, such as a powder puff, through the meshes of the netting.

As one example, a conventional structure of a refill container is shown in FIG. 5. As shown in the drawing, the conventional example is structured to prevent the cosmetic tool from being caught at a welded portion between a rim portion of the container body and a netting when adhering a cosmetic material to a cosmetic tool, such as a powder puff, by rubbing against the netting on the top surface of the refill container.

A refill container X shown in FIG. 5 is comprised of a container body 51, and a net frame 52 capping the container body 51. The refill container X is contained inside a compact container 53 comprised of a compact lid 53A and a compact body 53B, wherein the compact container 53 could be used repeatedly by replacement of a new refill container whenever the cosmetic material inside the refill container X is used up.

The container body 51 is a shallow dish-shaped container formed from a flexible synthetic resin material having a flange 51*b* at an outer periphery of an opening portion 51*a*. The net frame 52 has a structure where a sheet-like netting 52*b* is stretched at an inner side of an engagement loop 52*a* being an annular body shaped as a circle. An annular attachment portion 52*c* between the engagement loop 52*a* and the netting 52*b* is in a projecting state, wherein the netting 52*b* is structured emerging higher upward than the engagement loop 52*a*. Further, an engagement claw is formed at a peripheral rim of the net frame 52, and the container body 51 and the net frame 52 are engaged by engaging the engagement claw to the flange 51*b* of the container body 51.

It should now be noted that the refill container X is manufactured by filling the cosmetic material K inside from the opening portion 51*a* of the container body 51, and then, by covering a top end of the opening portion 51*a* with the net frame 52.

Nevertheless, the netting 52*b* being structured emerging higher upward than the engagement loop 52*a* creates a large space S2 between the netting 52*b* of the net frame 52 and a top surface of the cosmetic material K filled within the container body 51. The height of the top surface of the cosmetic material K could not surpass the height of the top end of the opening portion 51*a* of the container body 51, and further, it is impossible to make the height of the netting 52*b* lower than that of the engagement loop 52*a* in a means for preventing a creation of a difference in level, which causes accumulation of cosmetic material K between the engagement loop 52*a* and the netting 52*b*.

Accordingly, the large space S2 causes the cosmetic material K to accumulate on one side when the compact container 53 is transported or displayed, and would result to rendering of product appearance, as well as affecting the quality of the cosmetic material K from the air inside the space S2.

Therefore, it is an object of this invention to provide a refill container for preventing the cosmetic material from accumulating on one side by forming the space between the top surface of the cosmetic material K and the netting, as small as possible, and for preventing the quality of cosmetic material from changing.

SUMMARY OF THE INVENTION

A netted refill container regarding the present invention serves to solve the foregoing problems and comprises: a container body being formed from a flexible synthetic resin material, and opening upward for containing cosmetic material; a net frame having a netting hooked across an engagement loop; wherein the net frame is attached in a manner covering an opening portion of the container body; wherein the netting and the engagement loop are attached by an annular attachment portion projecting higher upward than the engagement loop; wherein the opening portion of the container body has a top edge extending upward to form an opening rim portion; and wherein the opening rim portion closely contacts to the annular attachment portion.

BRIEF DESCRIPTION OF THE DRAWINGS

The above and other objects and features of the invention are apparent to those skilled in the art from the following preferred embodiments thereof when considered in conjunction with the accompanied drawings, in which.

DESCRIPTION OF THE PREFERRED EMBODIMENTS

Figure 1:
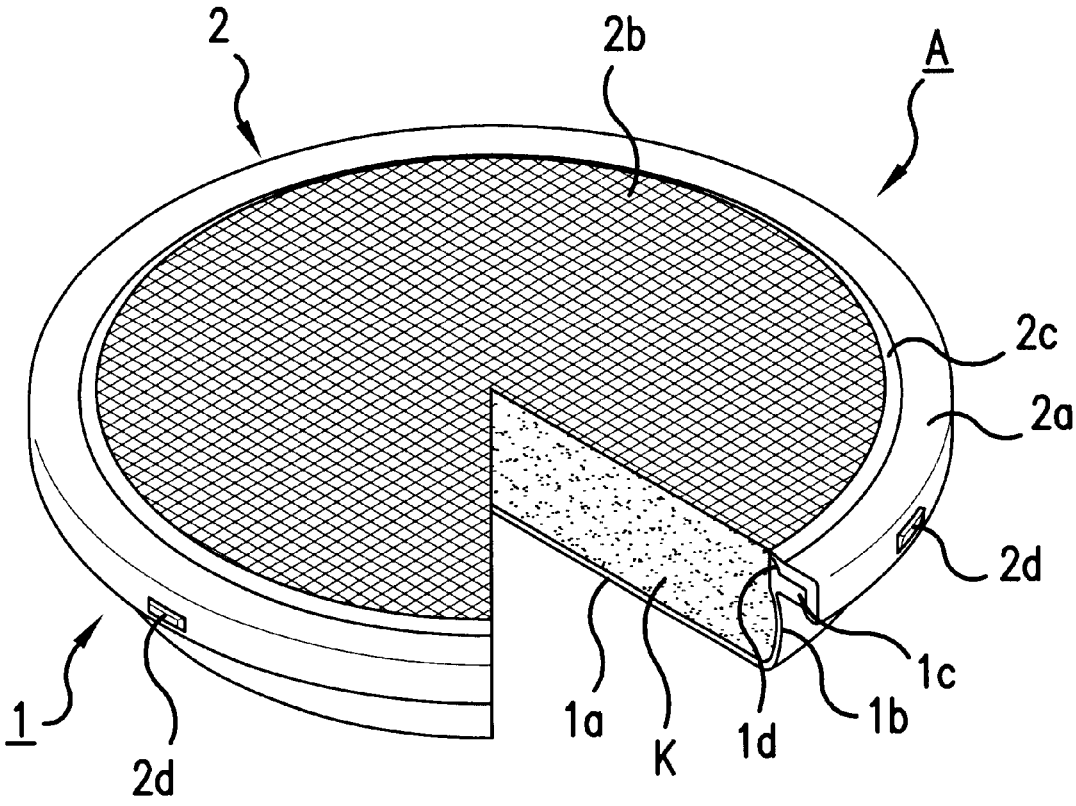
FIG. 1 is a perspective view showing a partially dissected refill container of an embodiment for the present invention.

An embodiment for this invention will hereinafter be described with reference to FIG. 1 through FIG. 4. FIG. 1 is a perspective view showing a refill container regarding this embodiment, FIG. 2 is a cross section view showing a compact container containing the refill container, FIG. 3 is an enlarged cross section view showing an engaging portion at a periphery of a frame body of a refill container, and FIG. 4 is a cross section view showing the compact container having a lid in an open state.

Figure 2:
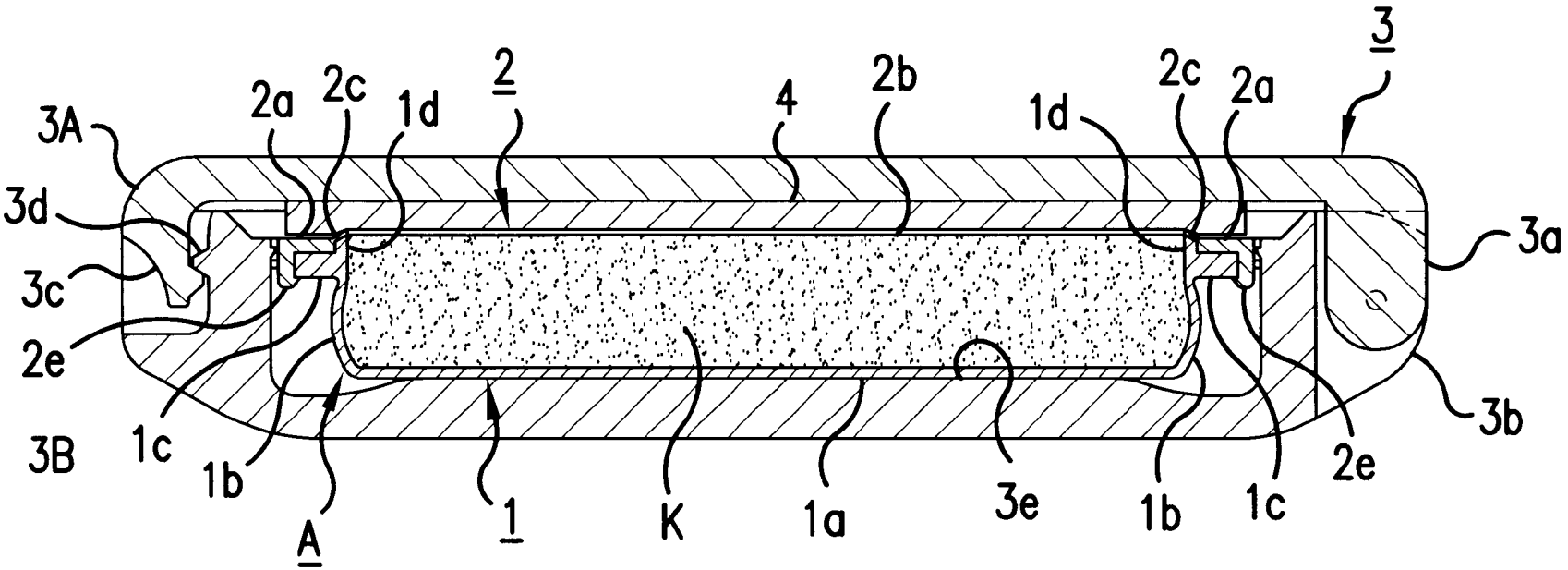
FIG. 2 is a side cross sectional view showing a compact container installed with the refill container, and with a lid in a closed state.
Figure 3:
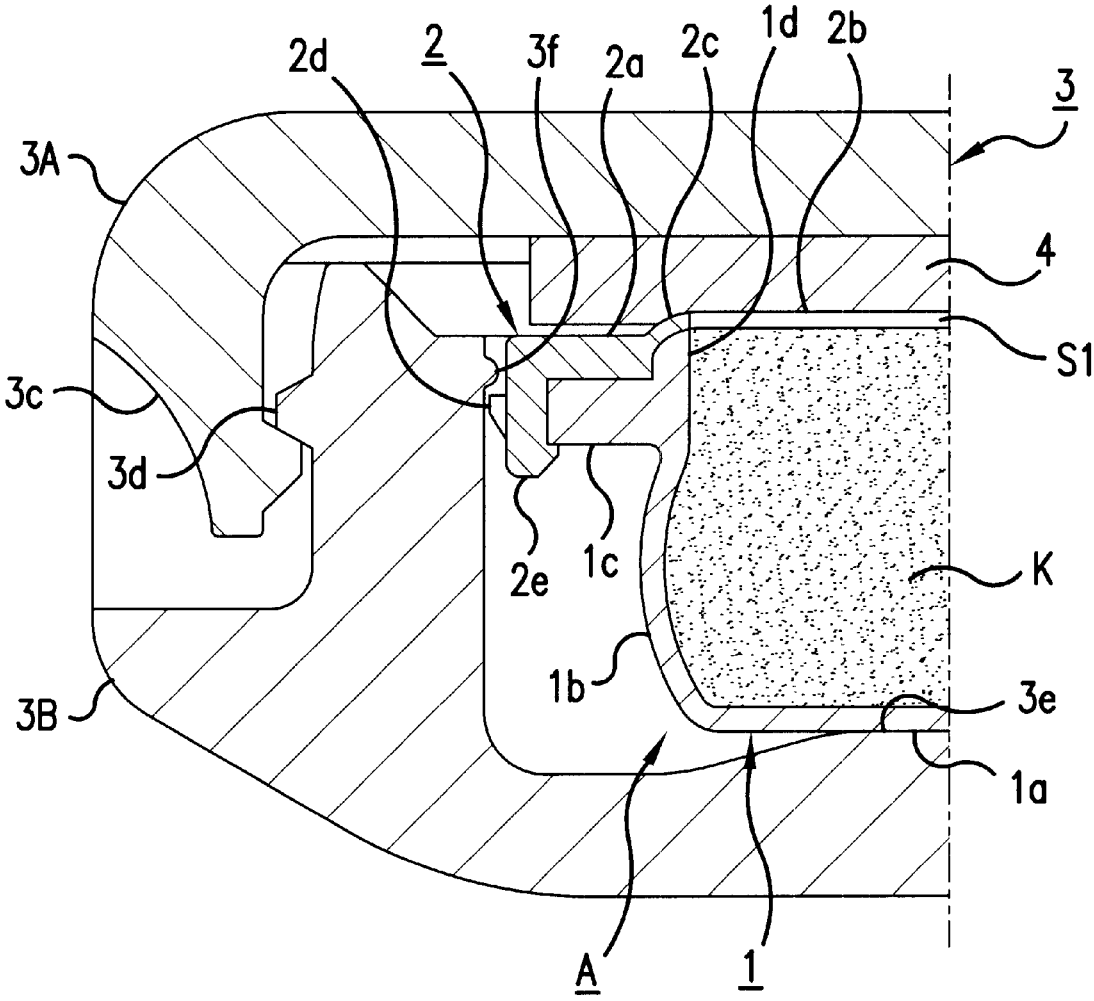
FIG. 3 is an enlarged cross sectional view showing a portion of the compact container.
Figure 4:
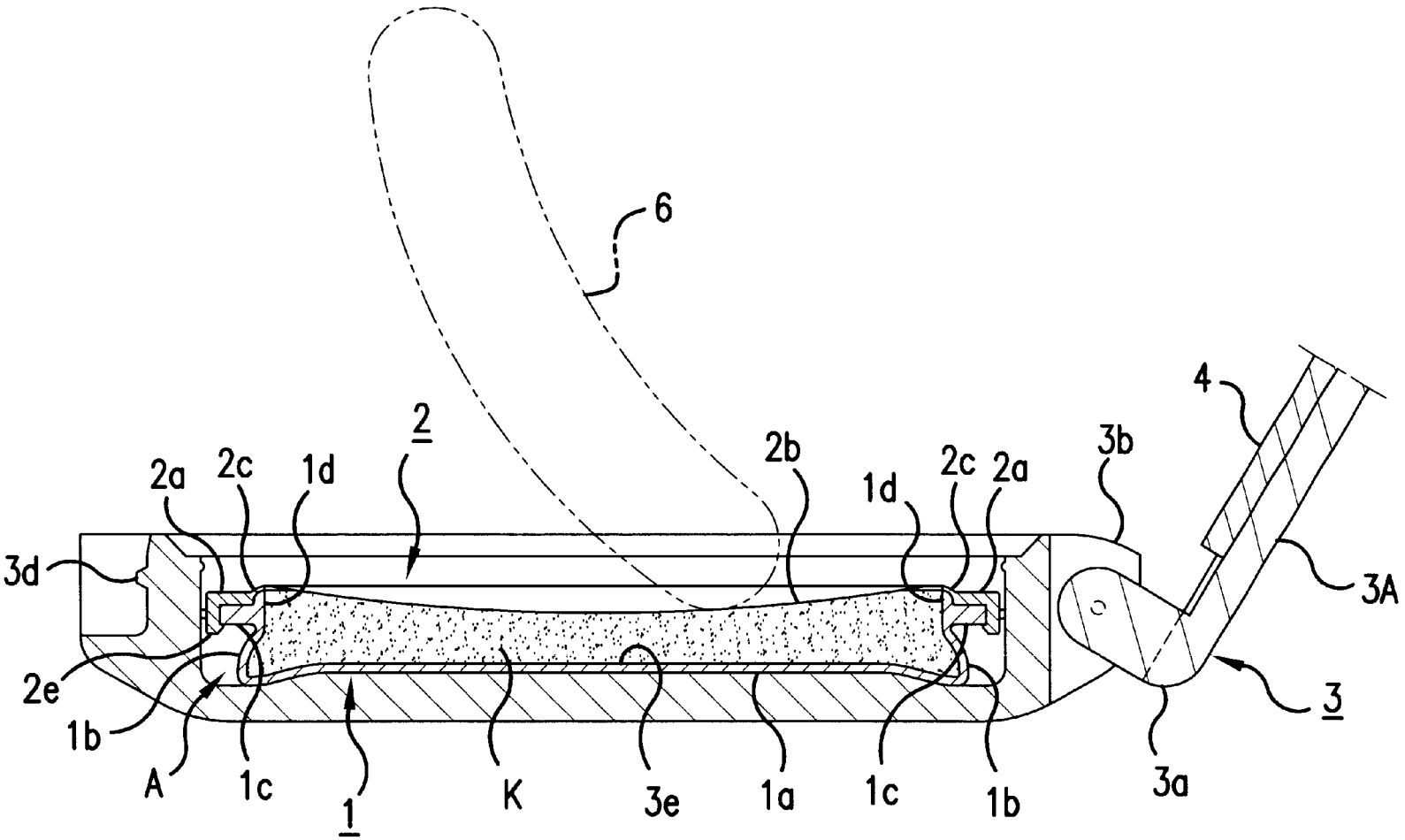
FIG. 4 is a side cross sectional view showing the compact container with a lid in an opened state.
Figure 5:
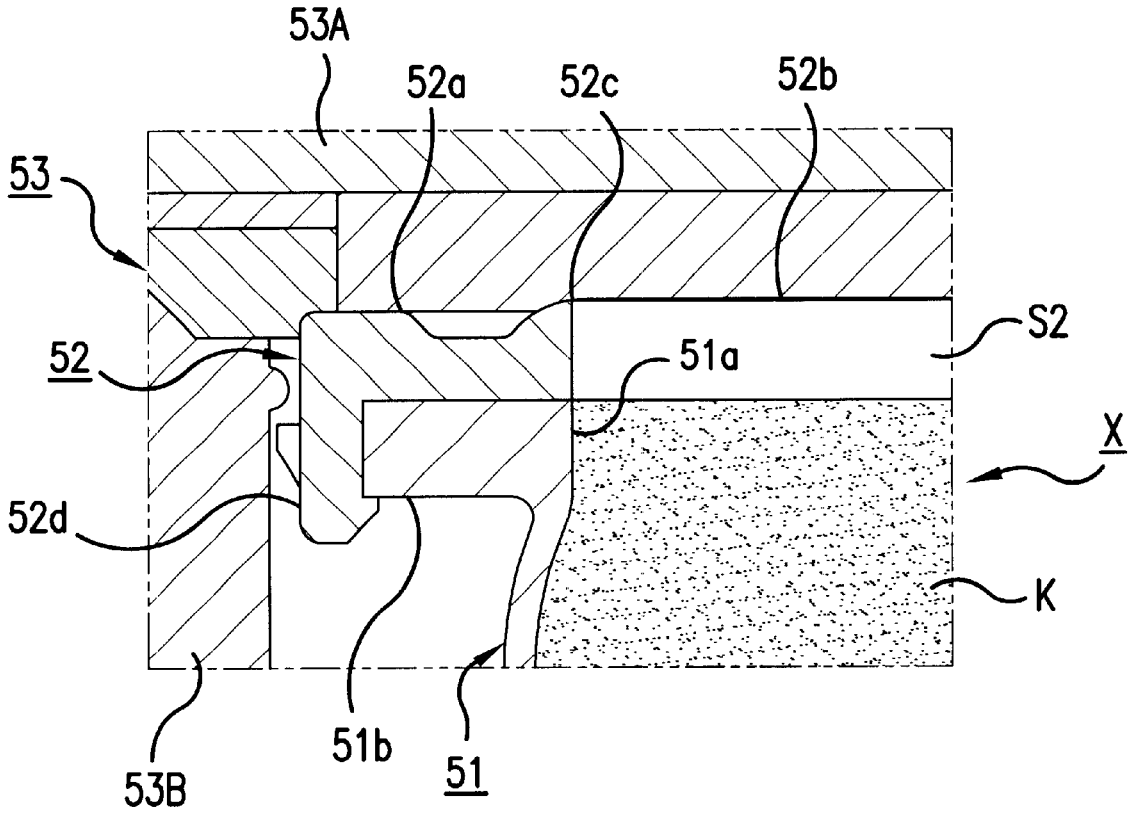
FIG. 5 is an enlarged cross sectional view showing a portion of a compact container installed with a conventional refill container.

As shown in FIG. 1 through FIG. 3, a replaceable refill container A is contained inside a compact container 3, wherein the refill container A is comprised of a container body 1 and a net frame 2. The cosmetic material K contained inside the container body 1 is a powdery cosmetic material such as foundation or white powder, or a slightly moistened putty-like cosmetic material.

The container body 1 is a shallow dish shaped container having: a flat bottom portion 1*a*; a side peripheral surface 1*b* bulging outward forming a shape of a greater-than symbol ("<"); a flange 1*c* formed at the outer periphery of a opening portion; and an opening rim portion 1*d* being extended upward. The container body 1 is entirely formed into a whole body with a flexible synthetic resin material, e.g. elastomer material such as urethane. Accordingly, when a pressing force is applied to the container body 1 from above, the side peripheral surface 1*b* collapses in a folding manner, and allows the bottom portion 1*a* to push out the contained cosmetic material in an upward direction. Further, a top edge of the opening rim portion 1*d* of the container body 1 is extended to a position higher than the flange 1*c*.

The net frame 2 has a structure where a sheet-like netting 2*b* is stretched at an inner side of an engagement loop 2*a* being an annular body with a circular shape. The net frame 2 is formed with an insert molding method, wherein the netting 2*b* being cut in a circular shape is placed into a metal mold during injection molding of the engagement loop 2*a* so that the netting 2*b* and the engagement loop 2*a* becomes a united body. An annular attachment portion 2*c* between the engagement loop 2*a* and the netting 2*b* is stood upright, and the surface of the netting 2*b* is positioned higher than that of the engagement loop 2*a*. That is, the netting 2*b* is structured to upwardly emerge higher than the engagement loop 2*a*. The bottom surface of the annular attachment 2*c* has a curved shape corresponding to the shape of the opening rim portion 1*d* of the container body 1. Further, an engagement projection 2*d* is formed at a peripheral side surface of the engagement loop 2*a* to prevent the refill container A from falling from the compact container 3.

The thus formed engagement loop 2*a* of the net frame 2 has a diameter substantially equal to that of the opening portion of the container body 1, and has a claw portion 2*e* formed at the peripheral side surface thereof, wherein the claw portion 2*e* is extended around and engaged to a bottom side of the flange 1*c* of the container body 1 for engaging the container body 1 and the net frame 2.

In such state, the opening rim portion 1*d* of the container body 1 contacts to a recessed bottom surface of the annular attachment portion 2*c* of the net frame 2, and a top edge of the opening rim portion 1*d* and the netting 2*b* are arranged extremely close to each other. Since the cosmetic material K could be filled up to the height of the top edge of the opening rim portion 1*d*, a space S1 formed between a top surface of the cosmetic material K and the net frame 2 would be extremely small.

The refill container A described above is contained inside the compact container 3. The compact container 3 is assembled from a lid member 3A and a container body 3B, wherein each the lid member 3A and the container body 3B have a hinge member 3*a*, 3*b* formed on one side, and an engagement projection 3*c*, 3*d* formed on the other side. Further, the lid member 3A becomes openable and closable in correspondence to the container body 3B by rotatively attaching the hinges 3*a*, 3*b* with each other, and could maintain a closed state by engaging the engagement projections 3*c*, 3*d*. It is now to be noted that a projection 3*e* is formed at a bottom portion inside the container body 3B, and the refill container A is placed on the projection 3*e* when the refill container A is contained inside the container body 3B.

An engaging ring 3*f* is formed at an inner peripheral surface of the opening portion of the container body 3B of the compact container 3, and the engagement projection 2*d* formed at the side peripheral surface of the net frame 2 extends around the bottom side of the engaging ring 3*f* when the refill container A is engaged to the container body 3B so as to prevent the refill container A from easily falling from the compact container 3. It is now to be noted that when the cosmetic material K inside the refill container A is used up and a replacement of a new refill container A is required, the engagement between the engagement projection 2*d* and the engaging ring 3*f* could be released and the refill container A could easily be detached by transforming the refill container A with applying force to the rim of the refill container A.

A packing 4 being an elastic sheet member is attached to a reverse surface of the lid member 3A of the compact container 3. By closing the lid member 3A, the packing 4 contacts closely to a top surface of the net frame 2 of the refill container A, and entirely covers the meshes of the netting 2*b* so that spillage of the cosmetic material K could be securely prevented.

The usage of this embodiment will be described with reference to FIG. 2 through FIG. 4. In a manner shown in FIG. 2, the lid member 3A of the compact container 3 is closed during storage or conveyance of the compact container 3. In such state, the packing 4 attached to the reverse surface of the lid member 3A transforms in a manner contacting upon the netting 2*b* erected upward and the annular attachment portion 2*c*, and seals the meshes of the netting 2*b* and the annular attachment portion 2*c* arranged at the peripheral edge of the netting 2*b* securely.

Next, as shown in FIG. 4, when the lid member 3A of the compact container 3 is opened during usage, the packing 4 along with the lid member 3A is separated to expose the net frame 2 of the refill container A. Subsequently, a cosmetic tool 6 such as a powder puff is rubbed against the net frame 2 to allow a suitable amount of cosmetic material K to adhere upon the cosmetic tool 6 for usage.

In this case, the bottom portion 1*a* of the container body 1 of the refill container A transforms in a manner contacting to the projection 3*e* at the bottom portion of the compact container body 3B, when the cosmetic tool 6 is pressed against the net frame 2. During such case, the side peripheral surface of the refill container 1*b* is bent in a manner folding into a shape of a greater-than symbol ("<"), and the position of the netting 2*b* is lowered so that a suitable amount of cosmetic material K could be used constantly in correspondence with the remaining cosmetic material K.

Further, the refill container A described in this embodiment is manufactured by filling the container body 1 with cosmetic material K, and then, by attaching thereupon the net frame 2. In this case, although the cosmetic material K could be filled up to the tip edge of the opening rim portion 1*d*, the space S1 between the top surface of the cosmetic material K and the netting 2*b* would be extremely small since the opening rim portion 1*d* closely contacts to the attachment position (annular attachment portion 2*c*) between the netting 2*b* and the engaging ring 2*a*.

Accordingly, even if the refill container A is vertically positioned or tilted when being transported or displayed, the cosmetic material K could be prevented from over-accumulating on one-side within the space S1. Further, since the remained air inside the space S1 is reduced, a refill container being capable of minimizing the influence of air upon the cosmetic material K and being capable of not affecting the quality of the cosmetic material K could be provided.

As described above, regarding the refill container for the present invention, the space between the top surface of the cosmetic material and the netting could be reduced by extending the opening of the container body upward for forming the opening rim portion, and by closely contacting the top edge of the opening rim portion upon the netting of the net frame.

Accordingly, the cosmetic material could be prevented from overly accumulating on one-side, even when the refill container or the compact container attached with the refill container is tilted. Further, since the air contacting to the cosmetic material is reduced, a refill container having little effect on the quality of the cosmetic material could be provided.

The foregoing description of a preferred embodiment of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined by the claims set forth below.

What is claimed is:

1. A netted refill container comprising:

a container body being formed from a flexible synthetic resin material, and opening upward for containing cosmetic material;

a net frame having a netting hooked across an engagement loop;

wherein the net frame is attached in a manner covering an opening portion of the container body;

wherein the netting and the engagement loop are attached by an annular attachment portion projecting higher upward than the engagement loop;

wherein the opening portion of the container body has a top edge extending upward to form an opening rim portion; and wherein the opening rim portion closely contacts to the annular attachment portion.

* * * * *